US008840213B2

(12) United States Patent
Imamura

(10) Patent No.: US 8,840,213 B2
(45) Date of Patent: Sep. 23, 2014

(54) IMAGE-FORMING DEVICE AND METHOD FOR FORMING AN IMAGE

(75) Inventor: Atsushi Imamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 268 days.

(21) Appl. No.: 13/420,980

(22) Filed: Mar. 15, 2012

(65) Prior Publication Data

US 2012/0242736 A1 Sep. 27, 2012

(30) Foreign Application Priority Data

Mar. 23, 2011 (JP) ..... 2011-064432

(51) Int. Cl.
*B41J 29/393* (2006.01)
*B41J 11/00* (2006.01)
*B41J 15/04* (2006.01)

(52) U.S. Cl.
CPC ..... *B41J 11/0085* (2013.01); *B41J 11/002* (2013.01); *B41J 15/04* (2013.01)
USPC ..... 347/16; 347/19; 347/104

(58) Field of Classification Search
CPC ..... B41J 11/0085; B41J 11/002
USPC ..... 347/16, 104, 102, 19
See application file for complete search history.

(56) References Cited

U.S. PATENT DOCUMENTS 7,207,269 B2 4/2007 Yoshida
7,469,999 B2 * 12/2008 Kadomatsu et al. ..... 347/55
2007/0146457 A1 * 6/2007 Kito ..... 347/101

FOREIGN PATENT DOCUMENTS

JP 2004-313829 A 11/2004
JP 2010-158814 A 7/2010

* cited by examiner

*Primary Examiner* — Julian Huffman
(74) *Attorney, Agent, or Firm* — Global IP Counselors, LLP

(57) ABSTRACT

An image-forming device includes an image-forming part, a conveying part, a suction part and a control part. The image-forming part is configured and arranged to form an image on a recording material that is rolled up in a recording material roll. The conveying part is configured and arranged to feed out the recording material from the recording material roll and to convey the recording material to the image-forming part. The suction part is configured and arranged to suction the recording material conveyed by the conveying part, the suction part being disposed at the image-forming part. The control part is configured to control a suction characteristic of the suction part according to a conveyance amount of the recording material after the recording material has begun to be conveyed by the conveying part.

8 Claims, 14 Drawing Sheets

IMAGE-FORMING DEVICE AND METHOD FOR FORMING AN IMAGE

CROSS-REFERENCE TO RELATED APPLICATIONS

This application claims priority to Japanese Patent Application No. 2011-064432 filed on Mar. 23, 2011. The entire disclosure of Japanese Patent Application No. 2011-064432 is hereby incorporated herein by reference.

BACKGROUND

1. Technical Field

The present invention relates to an image-forming device and a method for forming an image, in which an image is formed by an image-forming part on a long roll of paper or other recording material.

2. Related Art

Color inkjet printers of a type that discharges ink of a variety colors from image-forming heads and forms an image on printing paper or another recording material have become widespread as output devices for computers in recent years. Comparatively large color inkjet printers for using a plurality of image-forming heads to print on rolled paper or another recording material have also been implemented recently.

A device is described in Japanese Laid-Open Patent Application No. 2010-158814 for conveying rolled paper or another continuous article while holding the article in tension on rollers, discharging ink using inkjet heads, and recording an image on the media. In such a device, a tension unit, a steering control unit, or the like is usually provided to an area stretching from a feeder to an image-forming part, and the media is conveyed while being held in tension on the rollers.

Japanese Laid-Open Patent Application No. 2004-313829 discloses providing a suction-type slack-preventing member as shown in (53 in FIG. 9) for minimizing slack in the media at the image-forming part.

SUMMARY

However, the recording material that is fed out in such devices may be temporarily released when the power is turned off, during printer standby, or at other times. Depending on the type of recording material, in such released states, the recording material may ruffle in the direction (the widthwise direction below) perpendicular to the conveyance direction due to moisture absorption, or the edge part may begin to curl. Alternatively, there may be a tendency to wrap around small-diameter rollers.

When printing operations are initiated in such a state, the recording material that has begun to curl or wrap is then conveyed to the image-forming part for forming images. Minimizing curling or wrapping tendencies using the normal suction force of a suction platen is therefore difficult, and the image that originally should have been formed at the curling or wrapping portion may be disturbed. Contact of the heads on the recording material may disturb images even at portions that are not curled or wrapped, and such contact may damage the heads or cause other defects.

It is therefore thought that the head portions should be retracted and contact avoided at the portions of the recording material that are curled or wrapped, but printing cannot be performed when the head portions are retracted. Useless recording material that cannot be used for printing is therefore produced, and productivity is reduced. It is also possible that a suction force sufficient to limit curling and wrapping on the suction platen should be imparted from the start, but after these portions have passed the image-forming part, imparting excessive suction force causes increased conveying load and reduced responsiveness of meander control and leads to reduced image quality.

In order to solve the aforedescribed problems, an image-forming device according to a first aspect of the present invention includes an image-forming part, a conveying part, a suction part and a control part. The image-forming part is configured and arranged to form an image on a recording material that is rolled up in a recording material roll. The conveying part is configured and arranged to feed out the recording material from the recording material roll and to convey the recording material to the image-forming part. The suction part is configured and arranged to suction the recording material conveyed by the conveying part, the suction part being disposed at the image-forming part. The control part is configured to control a suction characteristic of the suction part according to a conveyance amount of the recording material after the recording material has begun to be conveyed by the conveying part.

In the image-forming device according to the above described aspect of the present invention, the control part is preferably configured to control the suction characteristic such that a suction amount for the recording material that has been fed out from the recording material roll upon an initiation of conveying the recording material is larger than a suction amount for the recording material that was wrapped up in the recording material roll upon the initiation of conveying the recording material.

In the image-forming device according to the above described aspect of the present invention, the image-forming part preferably includes an image-forming head configured and arranged to discharge ink onto the recording material and to form the image, and the suction part preferably has a first suction part disposed at a position facing the image-forming head.

In the image-forming device according to the above described aspect of the present invention, the ink discharged by the image-forming head is preferably photo-curing ink, the image-forming part preferably has a light-irradiating part configured and arranged to cure the photo-curing ink on the recording material, and the suction part preferably has a second suction part disposed at a position facing the light-irradiating part.

In the image-forming device according to the above described aspect of the present invention, the suction characteristic controlled by the control part preferably includes a suction-amount distribution in a direction perpendicular to a direction in which the recording material is conveyed.

In the image-forming device according to the above described aspect of the present invention, the suction characteristic controlled by the control part is preferably controlled based on a type of the recording material, which is set using an input part.

In the image-forming device according to the above described aspect of the present invention, the suction characteristic controlled by the control part is preferably controlled based on a period from stopping of conveyance of the recording material by the conveying part until conveyance is initiated.

A method for forming an image on a recording material according to another aspect of the present invention includes: feeding out the recording material from a recording material roll resulting from rolling up the recording material, and conveying by a conveying part the recording material to an image-forming part for forming an image on the recording material; suctioning the recording material using a suction part; forming the image on the recording material; and controlling a suction characteristic of the suction part according to a conveyance amount of the recording material after the recording material has begun to be conveyed by the conveying part.

According to the image-forming device and the method for forming an image according to the present invention, when the recording material is conveyed upon the initiation of image formation, appropriate suction characteristics are applied to the recording material that was in a released state during the stopping period, whereby the quality of image formation is improved, and damage to the image-forming part and other defects can be minimized. Images can also be formed on the portion of the recording material that was in a released state, and the usage efficiency of the recording material can therefore be improved.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
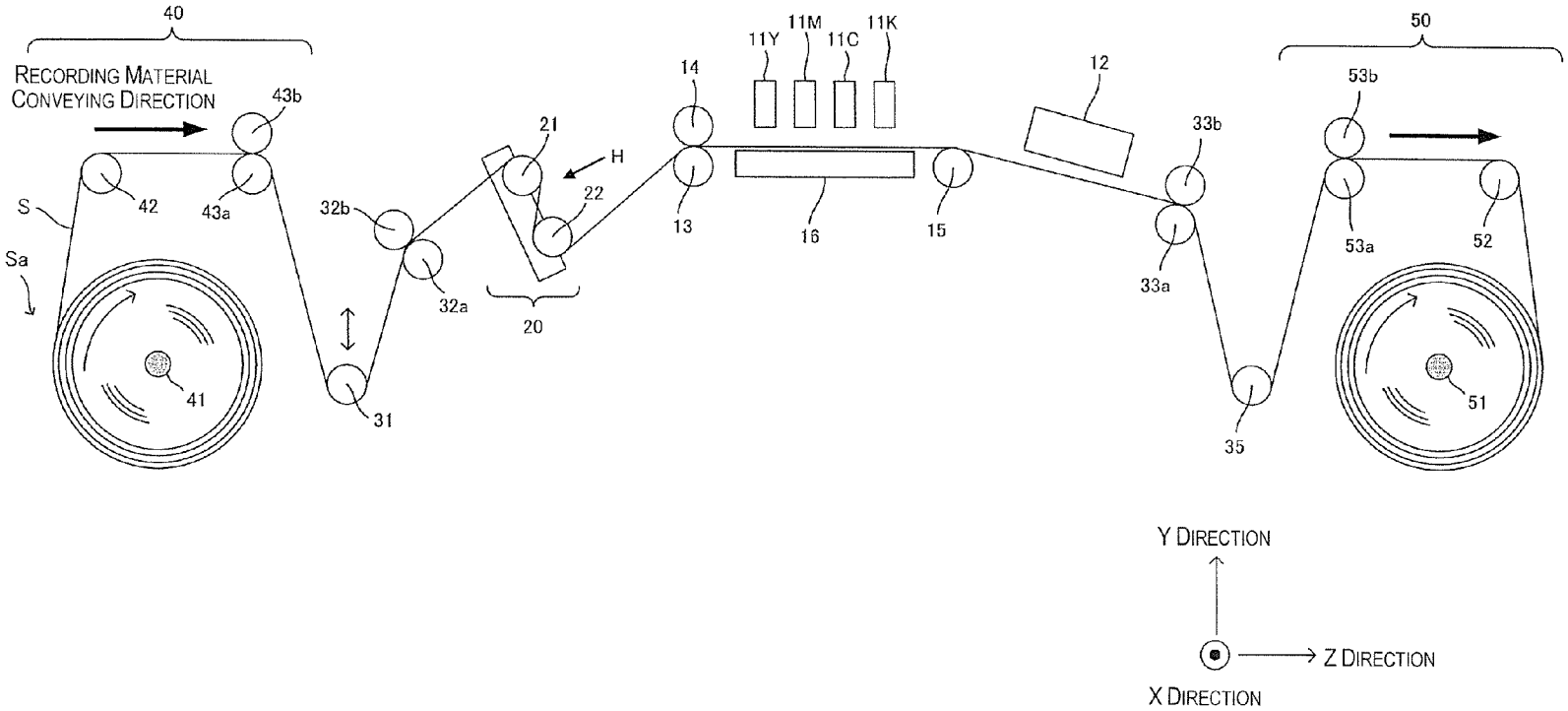
FIG. 1 shows the overall configuration of an image-forming device according to an embodiment of the present invention.

An embodiment of the present invention will be described with reference to the drawings. FIG. 1 shows the configuration of an image-forming device according to an embodiment of the present invention. The image-forming device according to the present embodiment uses photo-curing ink and is of a format involving a process in which ink is discharged from image-forming heads 11 onto a recording material S, then irradiated with light, and thereby fixed. Ultraviolet rays are employed as the light used in the present embodiment.

FIG. 1 is a lateral view of the image-forming device. As shown in FIG. 1, the direction in which the recording material S is carried is the Z direction, and the widthwise direction of the recording material S is the X direction. The primary configuration of the image-forming device includes color image-forming heads 11Y, 11M, 11C, 11K for forming (printing) pictures on the recording material S, and a conveying part comprising various rollers and the like for conveying the recording material S. Besides paper, label sheets, and cloth, plastic film and the like can be used as the recording material S.

The conveying part of the present embodiment is configured having, e.g., a feeder 40 for conveying the recording material S, which has been rolled up in a recording material roll Sa, toward the image-forming heads 11; a winder 50 for rolling up and collecting the images which have been formed by the image-forming heads 11; a meander-correcting part 20 for correcting conveyance shifting in the widthwise direction of the recording material S; a dancer roller 31 for preventing slackening of the recording material S carried out from the feeder 40; and a dancer roller 35 for preventing slackening of the recording material S near the winder 50.

The recording material S is carried out from the feeder 40, passes various rollers, and receives the ink discharged from the image-forming heads 11, after which the ink is irradiated by ultraviolet rays from a UV irradiator 12 (light-irradiating part) and fixed on the recording material S. The recording material is then collected into the winding part 50.

A continuous conveyance format in which conveyance is performed at a constant speed is employed for conveying the recording material S using the conveying part, i.e., conveying the recording material S for passing the lower surfaces of the image-forming heads 11. Besides this format, an intermittent conveying format may also be used. This format repeatedly alternates between conveying and stopping, and pictures are formed on the recording material by the image-forming heads 11Y through 11K when stopping.

The meander-correcting part 20 is a mechanism for correcting positional shifting in the widthwise direction (the X direction) of the recording material S, i.e., the direction perpendicular or substantially perpendicular to the conveying direction of the recording material S. The group of a front roller 21 and a rear roller 22 rotates, whereby the conveyed recording material S is moved in the widthwise direction, and the pictures printed on the recording material S by the image-forming heads 11Y through 11K are corrected to the proper position. The details of the configuration and control of this system are described in detail hereinafter.

A driving roller 13, a counter roller 14, and a driven roller 15 form a recording surface on which a picture is transferred by the image-forming heads 11Y through 11K. The recording material S is held in tension between these rollers, whereby the recording surface is formed. In the present embodiment, the conveying speed of the recording material S is controlled by the driving of the driving roller 13 positioned upstream of the image-forming heads 11. A stepping motor or the like capable of positional control or constant-speed control is therefore used for driving the driving roller 13.

A suction part 16 for pulling the recording material S in the reverse direction from the image-forming heads 11 is provided to the region below the recording surface formed by the driving roller 13 and the driven roller 15. An air-aspirating-type suction part 16 is used in the present embodiment, but, additionally, an electrostatic suction type may also be used. Besides a flat (platen) shape, the shape employed for the surface of the suction part 16 along which the recording material S passes may make an arc bending toward the image-forming heads 11 or be a variety of other shapes.

The UV irradiator 12 functions to irradiate ultraviolet rays and cure the UV-curable ink discharged onto the recording material S. The configuration is such that the light source of the UV irradiator 12 is, e.g., a UV-LED (ultraviolet light emitting diode) for producing ultraviolet rays. Metal halide lamps, xenon lamps, carbon arc lamps, chemical lamps, low-pressure mercury lamps, high-pressure mercury lamps, and like may also be used as the light source.

Figure 2:
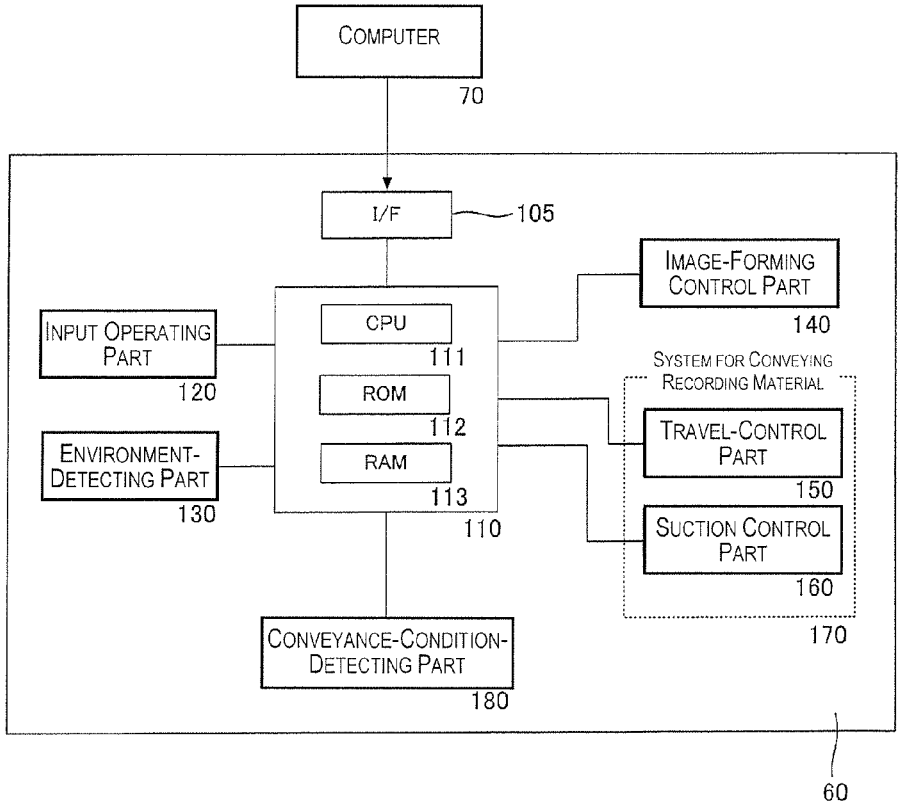
FIG. 2 shows the control configuration of the image-forming device according to an embodiment of the present invention.

FIG. 2 shows the control configuration of the image-forming device according to the embodiment of the present invention. A central control part 110 in this control configuration is composed of, e.g., a CPU 111, a ROM 112, and a RAM 113. A process program recorded in the ROM 112 is deployed in the RAM 113. The process program is executed by the CPU 111. An interface 105 is provided for connecting the central control part 110 of an image-forming device 60 and a computer 70.

The central control part 110 controls an image-forming control part 140, a travel-control part 150 that acts a control part 170 for the recording material-conveying system, and a suction control part 160 according to the process program. The central control part 110 controls the various control parts based on various information received from an input operating part 120 to which various settings are input by a user; an environment-detecting part 130 provided with various sensors for detecting temperature, humidity, and the like in the external environment; and a conveyance-condition-detecting part 180 for detecting the condition of conveyance of the recording material S.

Figure 3:
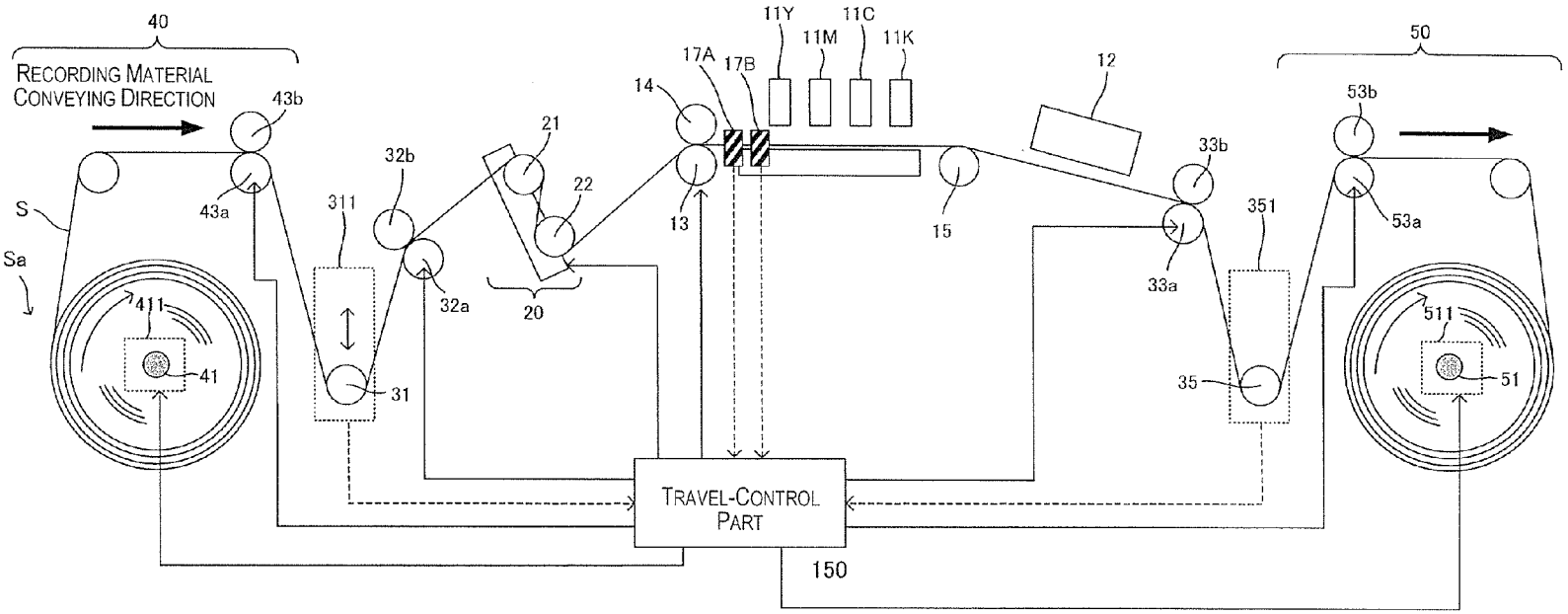
FIG. 3 shows the control configuration of the recording material-conveying part of the image-forming device according to an embodiment of the present invention.

FIG. 3 shows the control configuration of the recording material-conveying part of the image-forming device according to the embodiment of the present invention. The travel-control part 150 controls various driving systems related to conveying the recording material S. A motor or the like, which acts as a driving means provided to driving rollers 13, 43*a*, 53*a*, tension rollers 32*a*, 33*a*, and a winding shaft 51, is driven to rotate, whereby the recording material S is conveyed. Rubber rollers or other elastic rollers are employed so as to allow the driving force of the driving rollers to be conveyed to the counter rollers 14, 32*b*, 33*b*, 43*b*, 53*b* positioned opposite the corresponding driving rollers.

A powder brake 411 that acts as a rotation-inhibiting means is provided to a winding shaft part 41. Tension is applied to the recording material S by imparting a force for pulling the recording material S back in the direction opposite the conveying direction.

The dancer roller 31 can operate at various heights and provides a constant load to the recording material S that is fed out from the feeder 40. The driving roller 43*a* is driven based on the vertical position of the dancer roller 31 as detected by a dancer-roller position-detecting part 311. The length (buffer amount) of the recording material S between the first roller 43*a* and the tension roller 32*a* is kept within a predetermined range. The dancer roller 31 in the present embodiment is used to provide a buffer to the recording material S, whereby slack in the recording material S as generated by errors in the various travel systems is absorbed, and the travel characteristics of the recording material S can be made more favorable. The dancer roller 35, a dancer-roller position-detecting part 351, and a driving roller 53*a* are also provided in the same manner to the winder 50 side, and conveyance control is executed in the same manner as the feeder 40.

The meander-correcting part 20 in the present embodiment is provided for correcting conveyance shifting of the recording material S in the widthwise direction. In the present embodiment, the disposed position of the image-forming heads 11, i.e., positional shifting when forming the image on the recording material S, is particularly problematic. Two edge sensors 17A, 17B are provided to a portion (recording surface) held in tension by the driving roller 13 and the driven roller 15, and the positions of the edge portion of the recording material S are detected. The positions of the edge surface (edge) of the recording material S as detected by the edge sensors 17A, 17B are input to the travel-control part 150 and used in calculations for the amount of correction in the meander-correcting part 20.

Figure 4:
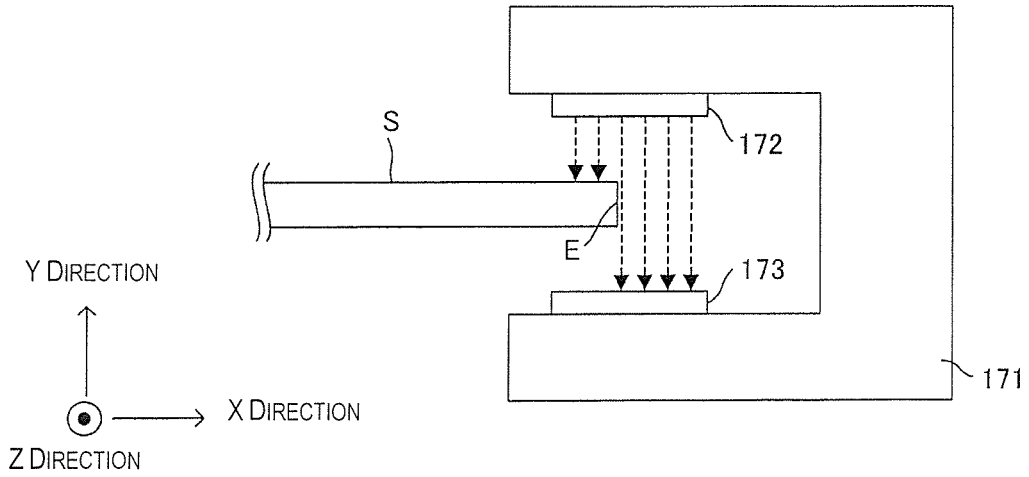
FIG. 4 shows the configuration of the edge sensor according to an embodiment of the present invention.

FIG. 4 shows the configuration of the first (second) edge sensor 17A (B) according to the embodiment of the present invention. These edge sensors 17 detect a position E of the edge surface of the conveyed recording material S. Optical-type sensors are employed in the present embodiment. All of the sensors 17A, 17B have the same configuration and are configured having a supporting member 171, a light-emitting part 172, and a light-receiving part 173. The light-emitting part 172 and the light-receiving part 173 are disposed facing each other on the supporting member 171. The position E of the edge surface of the recording material S passes through the interval where the light-emitting part 172 and the light-receiving part 173 face each other. Light emitted from the light-emitting part 172 is partially obscured by the recording material S passing through that interval, and the position E of the edge surface of the recording material can be detected using the amount of light received at the light-receiving part 173. Instead of a sensor in which the light-emitting part 172 and the light-receiving part 173 are used for detection using light, a sensor that makes use of an oscillating part and a signal-receiving part that use sound waves (ultrasonic waves) may also be used. Alternatively, a mechanical sensor may also be used, in which a contact for lightly contacting the position E of the edge surface of the recording material is used.

In the present embodiment, the first edge sensor 17A and second edge sensor 17B are arranged as shown in FIG. 3, and these sensors detect the positions of the position E of the edge surface of the recording material S using this arrangement. The meander-correcting part 20 is controlled, and positional shifting of the recording material S in the widthwise direction is minimized based on information on the positions of the edge surface as outputted from the edge sensors 17A, 17B.

FIG. 5 shows the configuration and operation of the meander-correcting part 20 according to the embodiment of the present invention. FIG. 5 is a schematic of the view from the side shown by the arrow H in the image-forming device shown in FIG. 1. Differences exist with the actual appearance of the conveyance of the recording material S in FIG. 5 in order to facilitate understanding. As depicted in FIG. 1, the meander-correcting part 20 is configured having the front roller 21 and the rear roller 22. The rollers 21, 22 are rotatably supported, and the rolled up recording material S is conveyed in the conveying direction shown in FIG. 5 (the downward direction in FIG. 5).

The meander-correcting part 20 is further provided with revolving shafts 212, 222, a frame 23, and revolving-shaft-supporting parts 211, 221. The front roller 21 is provided with the revolving shaft 212 on both ends, and the revolving shaft 212 is revolvably affixed to the frame 23 by the revolving-shaft-supporting part 211. The revolving shaft 222 provided on both ends of the rear roller 22 is revolvably affixed to the frame 23 by the revolving-shaft-supporting part 221 in the same fashion. The other ends of the rollers 21, 22 are also rotatably affixed to the frame 23. On the other hand, a rotational fulcrum 231 is provided to the frame 23, and the configuration allows rotation about this point. The rotation of the frame 23 thus causes the front roller 21 and the rear roller 22, which are disposed on the same frame 23, to rotate in the same direction. The rotation of the frame 23 is controlled by a meander-correcting actuator (not shown), whereby meander correction is executed for the recording material S.

Figure 5B:
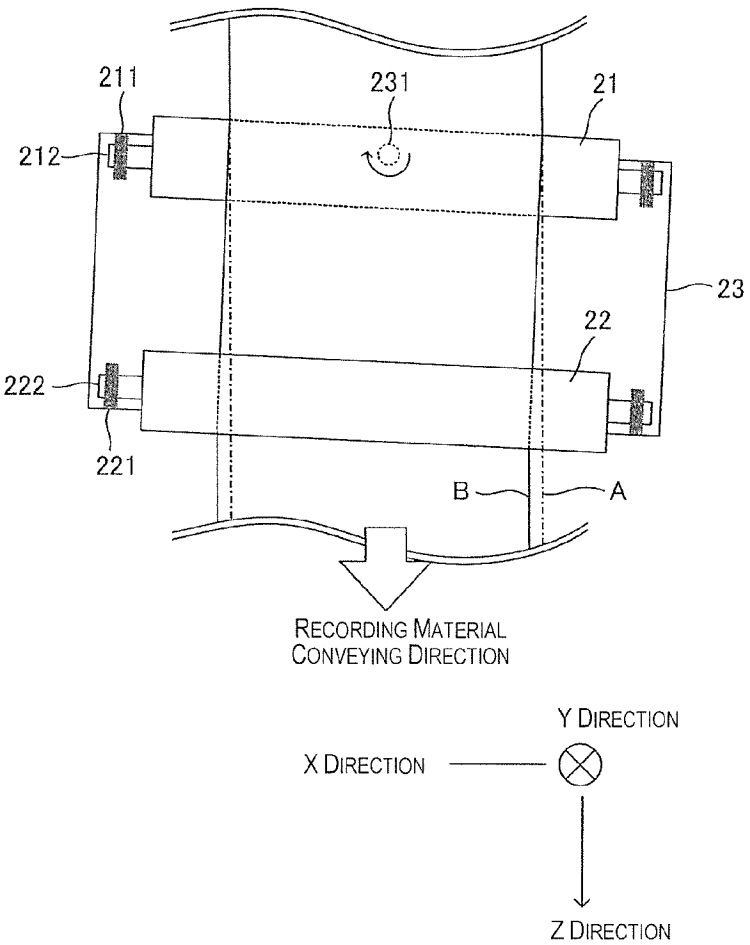
FIGS. 5A and 5B show the configuration and operation of the meander-correcting part according to an embodiment of the present invention.
Figure 5A:
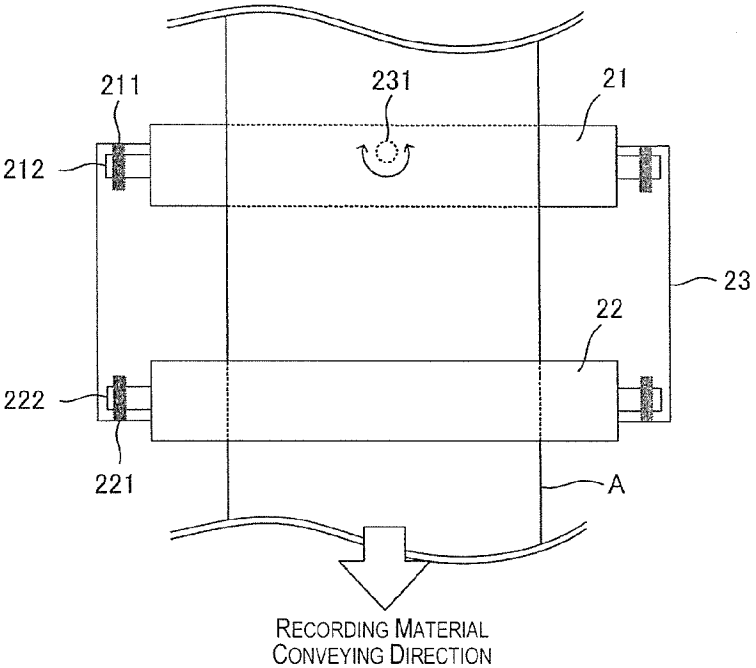

FIG. 5B shows the appearance during meander correction. The appearance shown is when the frame 23 is rotating clockwise. The edge surface of the recording material S at the time point of FIG. 5A is additionally shown using the dotted line A, but it can be seen that the recording material moves in the leftward direction, as shown by the solid line B, according to the rotation of the frame 23. The frame 23 in the present embodiment is made to rotate based on information on the positions of the edge surface as outputted from the two afore-described first and second edge sensors 17A, 17B, and the conveying position of the recording material S is adjusted to the appropriate position.

Figure 6:
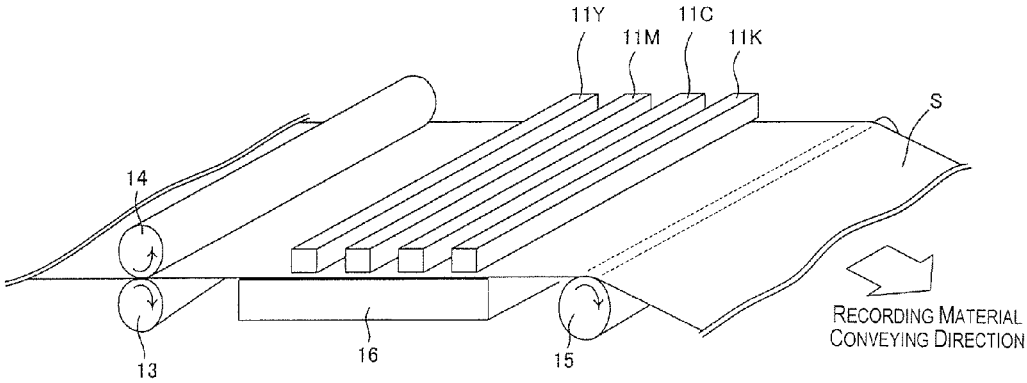
FIG. 6 is a perspective view that shows the configuration of the image-forming part according to an embodiment of the present invention.
Figure 7:
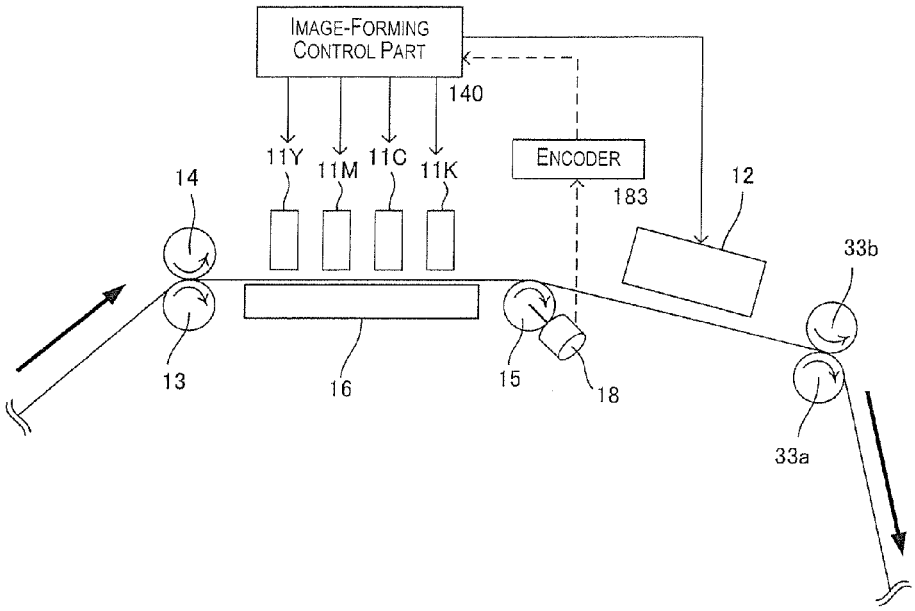
FIG. 7 shows the control configuration of the image-forming part of the image-forming device according to an embodiment of the present invention.

An embodiment of the image-forming part for forming images in the present invention will be described next. FIG. 6 is a perspective view showing the configuration of the image-forming part according to the embodiment of the present invention. FIG. 7 shows the control configuration of the image-forming part of the image-forming device according to the embodiment of the present invention.

As shown in FIG. 6, the image-forming device according to the embodiment of the present invention is configured provided with the plurality of the image-forming heads 11Y through 11K for discharging the UV-curable ink. These four image-forming heads 11Y through 11K discharge ink of the colors Y (yellow), M (magenta), C (cyan), and K (black), respectively, onto the recording material S and form pictures. The image-forming heads 11Y through 11K in the present embodiment are arranged in parallel along the entirety of the widthwise direction so as to allow printing on the entire area of the recording material S. Ink is discharged in the order of the respective image-forming heads 11Y, 11M, 11C, 11K, whereby the ultimate image is formed. After the ink is fixed by the UV irradiator 12, the recording material S is collected by the winder 50.

The recording material S that is sandwiched by the driving roller 13 and the counter roller 14 is conveyed by the rotation of the driving roller 13. The driven roller 15 that allows smooth rotation using bearings and the like without a drive system is provided downstream of the image-forming heads 11. The portion (recording surface) of the recording material S that is held in tension by the driving roller 13 and the driven roller 15 is suctioned and conveyed by the suction part 16, and pictures are formed using the colored inks discharged from the image-forming heads 11.

The ink discharged onto the recording material S passes the driven roller 15 and is fixed by the UV irradiator 12, but the driven roller 15 functions to separate the recording surface onto which ink has been discharged by the image-forming heads 11 and the fixing surface onto which ultraviolet rays are irradiated by the UV irradiator 12. Separating the recording surface and the fixing surface of the recording material S using the driven roller 15 minimizes the extent to which contraction of the recording material S affects the recording surface, where this contraction results from the effects of contraction of the ink during ultraviolet irradiation and the effects of the heat of the ink reaction.

Other rollers such as the counter roller 14 are not provided to the driven roller 15 for conveying the recording material S when carrying unfixed ink, and the recording material S is conveyed without disturbing the ink thereon. The driven roller 15 also functions as the conveyance-condition-detecting part used for detecting the amount of conveyance of the recording material S and preferably rotates so as to follow the recording material S. A metal roller is therefore used for the driven roller 15, and the surface is worked so as to have a high friction coefficient.

The driven roller 15 thus ideally rotates following the conveyance of the recording material S and is preferably made to come into adequate contact with the recording material S; i.e., the extent of wrapping is large. On the other hand, the unfixed ink adhering to the recording material S will run when the extent of the wrapping of the recording material S is large, and the image being formed may be disturbed. Therefore, in the present embodiment, the recording surface that is held in tension by the driving roller 13 and the driven roller 15 is kept in a horizontal or substantially horizontal direction, and the fixing surface that is held in tension by the driven roller 15 and the tension roller 33*a* is preferably set to a predetermined acute angle with respect to the recording surface.

Next will be described the extent of wrapping of the recording material S with respect to the driven roller 15, which wrapping is the reason for forming the angle between the recording surface and the fixing surface. The following items could be considered points of concerns in cases where the extent of wrapping (the wrapping angle) is large.

The unfixed ink adhering to the recording material S could run. In particular, when unfixed ink runs during pausing of the device as a result of paper jams, the tension roller 33*a* and the counter roller 33*b* positioned downstream may be soiled, or other problems may occur, and not just the recording material S but the device itself may be soiled.

Error can be generated between the speed of the surface of the recording material S in the image-forming part and the speed detected by the driven roller 15, and shifting could be generated in the image formed in cases where the image-forming timing is adjusted using the amount of rotation of the driven roller 15.

When label sheets having attached release liners are conveyed as the recording material S, the labels and release liners may peel apart in cases where the driven roller 15 has a small diameter (has a large amount of curvature).

On the other hand, the following items could be considered points of concerns in cases where the extent of wrapping (the wrapping angle) is small.

The driven roller 15 may cease to follow the recording material S, and shifting could be generated in the images formed in cases where the image-forming timing is adjusted using the amount of rotation of the driven roller 15.

The positional relationship of the image-forming heads 11Y through 11K and the UV irradiator 12 may cause the irradiated UV light (diffused light) to hit the nozzle surfaces of the image-forming heads 11Y through 11K for discharging the ink, and the nozzles may become clogged.

In consideration of the above, in cases where the recording surface, which is held in tension by the driving roller 13 and the driven roller 15, is held horizontal or substantially horizontal, the angle between the recording surface and the fixing surface, which is held in tension by the driven roller 15 and the tension roller 33*a*, is preferably set to 5° to 15°.

FIG. 7 shows the control configuration of the image-forming part according to the embodiment of the present invention. As described above, the driven roller 15 of the present embodiment also functions as a conveyance-condition-detecting part for detecting the amount of conveyance of the recording material S. The ink-discharge timing of the image-forming heads 11Y through 11K is controlled in the image-forming control part 140 based on the output of a rotary encoder 18 connected to the driven roller 15. The speed at which the recording material S is conveyed in the present embodiment is controlled by the driving roller 13 positioned upstream of the image-forming heads 11, but the recording material S sandwiched by the drive systems may slip, and the speed transmitted to the driving roller 13 may be different from the conveyance speed of the recording material S in such cases. The conveyance speed is therefore detected using the driven roller 15 in the present embodiment.

Figure 8:
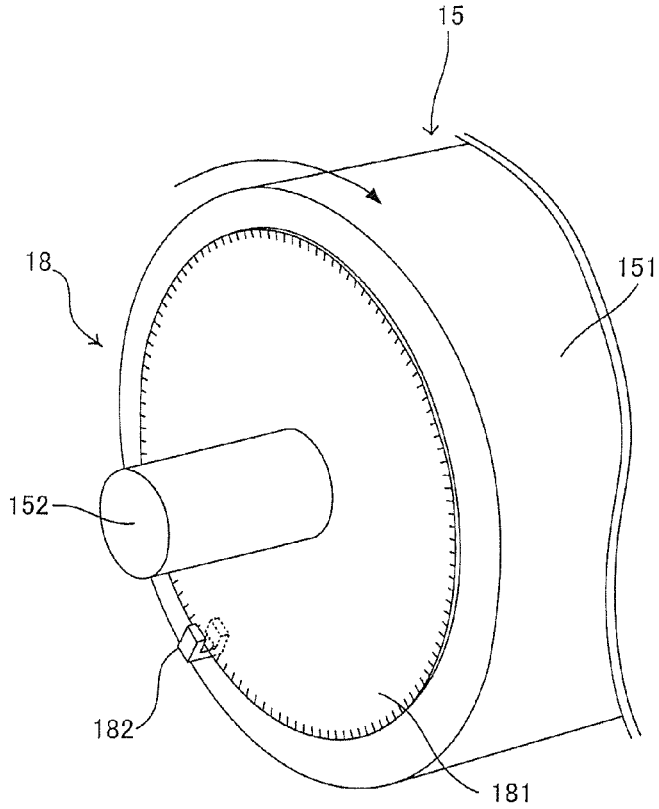
FIG. 8 shows the configuration of the rotary encoder according to an embodiment of the present invention.

The rotary encoder 18 (rotation-amount-detecting part) will now be described. The rotary encoder is a primary configurational component of the conveyance-condition-detecting part 180 used in the present embodiment. FIG. 8 depicts the rotary encoder 18. The rotary encoder 18 has a rotating disc 181, which has a plurality of slits provided at predetermined intervals, and a detecting part 182. The rotating disc 181 is affixed to a rotating shaft 152 of the driven roller 15 and rotates according to the rotation of the driven roller 15. The detecting part 182 is affixed to the frame or other part of the image-forming device 60.

Every time the slits provided to the periphery of the rotating disc 181 in the rotary encoder 18 pass the detecting part 182, a pulse signal ENC is outputted to the central control part 110. An encoder 183 ascertains the rotational angle and rotational speed of the driven roller 15 based on the pulse signal ENC, whereby the conveyance condition (conveyance speed, conveyance position) of the recording material S can be ascertained.

Figure 9:
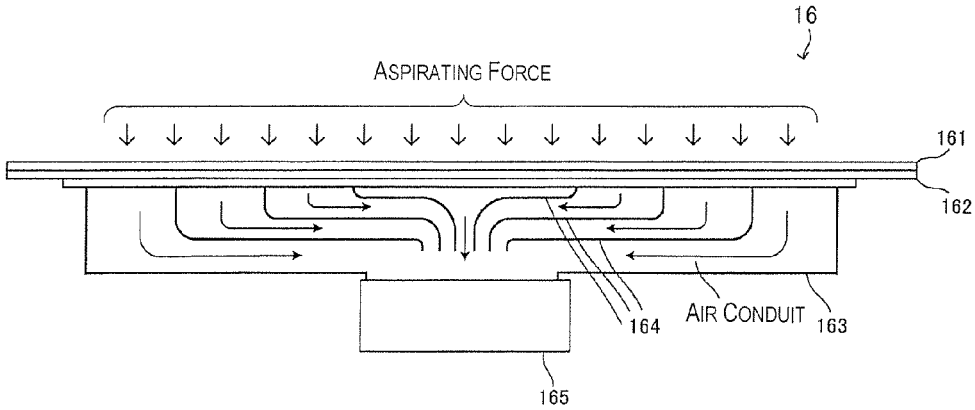
FIG. 9 is a cross-sectional view that shows the configuration of the suction part according to an embodiment of the present invention.

The configuration and control of the suction part 16 according to the embodiment of the present invention will now be described. FIG. 9 is a cross-sectional view that shows the configuration of the suction part 16 according to the embodiment of the present invention. The suction part 16 used in the present embodiment is an air-aspirating type. FIG. 9 is a cross-sectional view of the horizontal direction of the recording material S when the recording material S is being conveyed. The suction part 16 is configured to include a perforated metal plate 161, a plate 162, a casing 163, dividing walls 164, a sirocco fan 165, and the like.

Figure 10:
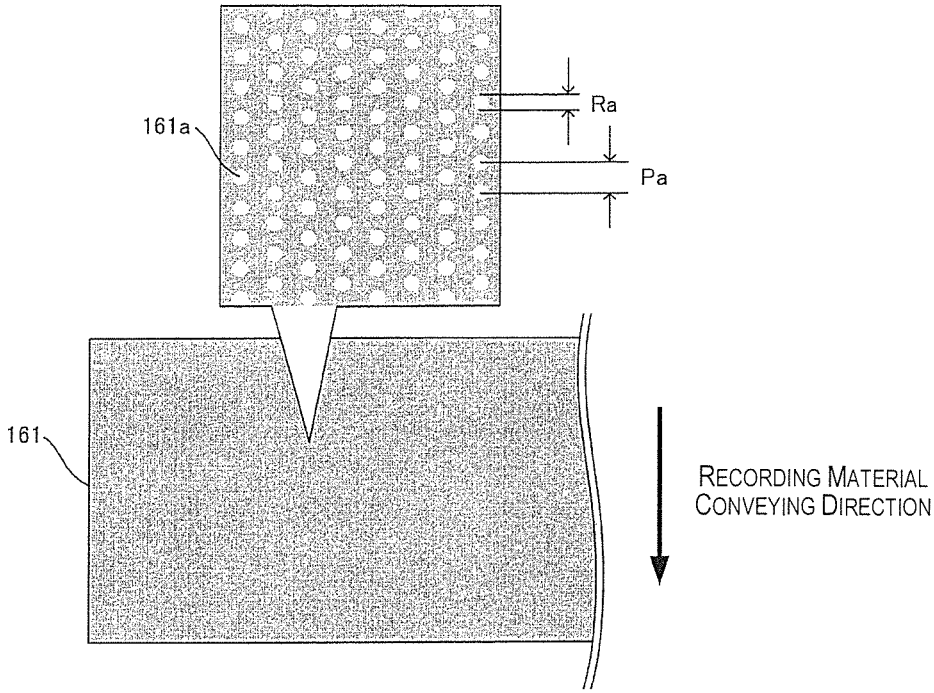
FIG. 10 shows the configuration of the perforated metal plate according to an embodiment of the present invention.

The perforated metal plate 161 has a surface that the recording material S contacts while passing. Fine ventilation holes 161*a* for aspirating air are provided to this surface. An enlarged view of the surface of the perforated metal plate 161 is given in the FIG. 10. A diameter Ra of the ventilation holes 161*a* is approximately 1 mm, and a pitch interval Pa is approximately 3 mm.

Figure 11:
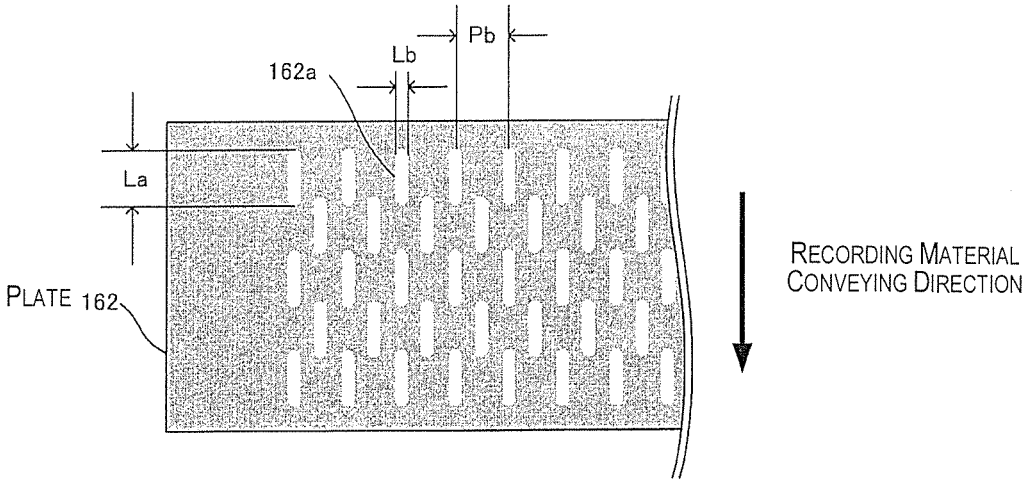
FIG. 11 shows the configuration of the plate according to an embodiment of the present invention.

The appearance of the surface of the plate 162 is depicted in FIG. 11. The plate 162 is a metal plate that is disposed in close proximity to the perforated metal plate 161. As in the perforated metal plate 161, ventilation holes 162*a* for aspirating air are provided to the plate. However, the ventilation holes 162*a* have a rectangular shape and are larger than the ventilation holes 161*a* of the perforated metal plate 161. Concerning the sides of this rectangle, a width La is approximately 20 mm, and a length Lb is approximately 5 mm. A pitch interval Pb is approximately 20 mm.

The ventilation holes for aspirating air in the present embodiment are formed in two layers on the perforated metal plate 161 and the plate 162. The ventilation holes 161*a* in the surface of the perforated metal plate 161 must be finely drilled so that the recording material S can pass by smoothly. The ventilation holes are therefore formed in two layers, and the comparatively thin perforated metal plate 161 is used on the side for making contact with the recording material S, whereby fine working is facilitated, and costs are reduced. Changing the patterns for forming the ventilation holes 161*a*, 162*a* of the perforated metal plate 161 and the plate 162, respectively, also allows the desired distribution of aspiration force to be obtained.

The casing 163 in which the dividing walls 164 are formed is positioned below the plate 162. Air conduits are formed within the casing 163 by the dividing walls 164. The air conduits form a connection between the ventilation holes 161*a*, 162*a*, which are formed in the perforated metal plate 161 and the plate 162, and the sirocco fan 165, which aspirates the air and is positioned at the ends of the air conduits. The sirocco fan 165 is operated, whereby an aspirating force acts on the surface of the perforated metal plate 161, and the recording material S is suctioned. Changing the amount of driving (amount of rotation) of the sirocco fan 165 in the present embodiment changes the aspirating force. The positioning and number of the dividing walls 164 are determined according to the required distribution of aspirating force.

Figure 12:
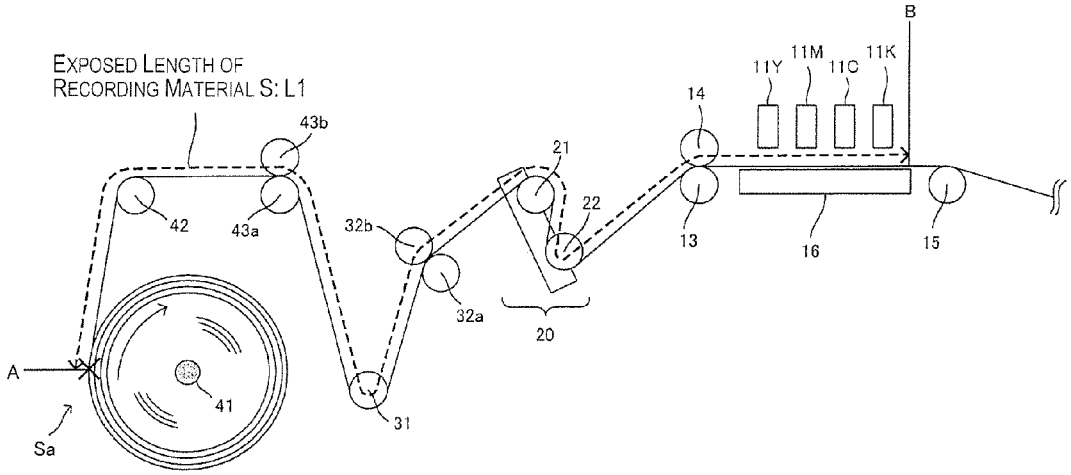
FIG. 12 depicts the location of the recording material in the image-forming device according to an embodiment of the present invention.

FIG. 12 depicts the location of the recording material S in the image-forming device according to the embodiment of the present invention. As described using FIG. 1 and the like, the recording material S is fed out from the recording material roll Sa, which is set in the image-forming device. The recording material passes various rollers and then receives ink discharged by the image-forming heads 11. Once set in the image-forming device, the recording material Sa may be temporarily released when power is turned off, during printer standby, during maintenance, or for other reasons. Absorption of moisture in the air by the recording material S at such times may result in ruffling in the widthwise direction, curling of the edge part, or a tendency to wrap around the driving roller 43*a* and other small-diameter rollers.

When printing is reinitiated, the ruffles, wrapping, or other such deformities in the recording material S cause the recording material to float below the image-forming heads 11, and formation of an ideal surface will be impeded. In cases where the amount of float is large, the recording material S will contact the image-forming heads 11, the image subsequently formed will be disturbed, and at worst damage to the image-forming heads 11 or other defects will result.

It is known that such ruffling and wrapping problems are particularly likely to occur when the recording material S is released in the position of the recording material S shown in FIG. 12 (an exposed length L1 depicted by the broken line), i.e., in the space between a feed-initiation position A of the recording material roll Sa and an image-forming completion position B of the image-forming heads 11. Setting the suction force of the suction part 16 to be large enough to handle the recording material S in such circumstances could be considered, but the suction force that acts on the recording material S when problems are not present is excessive in such instances. The traveling of the recording material S will be impeded, and the steering functionality of the meander-correcting part 20 will be reduced.

In the present embodiment, when the recording material has such problems during this interval (from position A to position B), the suction characteristics of the suction part 16 are changed from the suction force during normal travel, whereby these problems are resolved.

Figure 13:
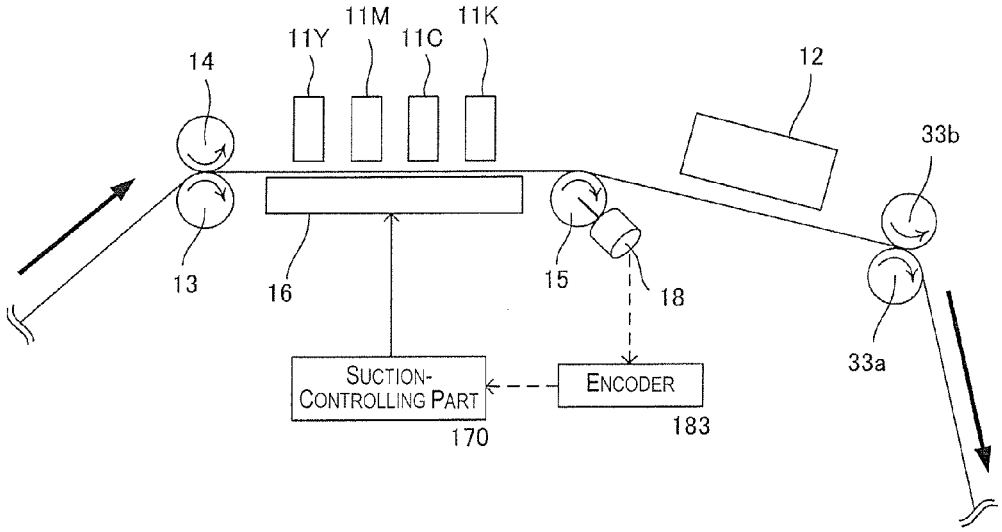
FIG. 13 shows the control configuration of the suction part according to an embodiment of the present invention.

FIG. 13 shows the control configuration of the suction part 16 according to the embodiment of the present invention. The suction characteristics of the suction part 16 are controlled by the suction control part 160. As described using FIG. 9, the suction part 16 of the present embodiment can change the aspirating force according to amount of rotation of the sirocco fan 165. The suction force of the suction part 16 is the suction characteristic that is changed in the present embodiment. For portions of the recording material S that have ruffling, wrapping tendencies, or other problems, the aspirating force is set to be larger than during normal travel.

The rotary encoder 18 for detecting the amount of rotation of the driven roller 15 used in image-forming control is used in the conveyance-condition-detecting part 180 for detecting when the recording material S positioned at the position A has reached the position B after the initiation of printing. The pulse signal ENC that is outputted from the rotary encoder 18 is encoded by the encoder 183 and outputted to the suction control part 160. The amount of conveyance of the recording material S can be determined in the suction control part 160 based on the signal from the rotary encoder 18. Besides using the rotary encoder 18, a variety of other formats can be employed for determining the amount of conveyance of the recording material S; e.g., monitoring the amount of the recording material S fed out by the feeder 40.

Figure 14:
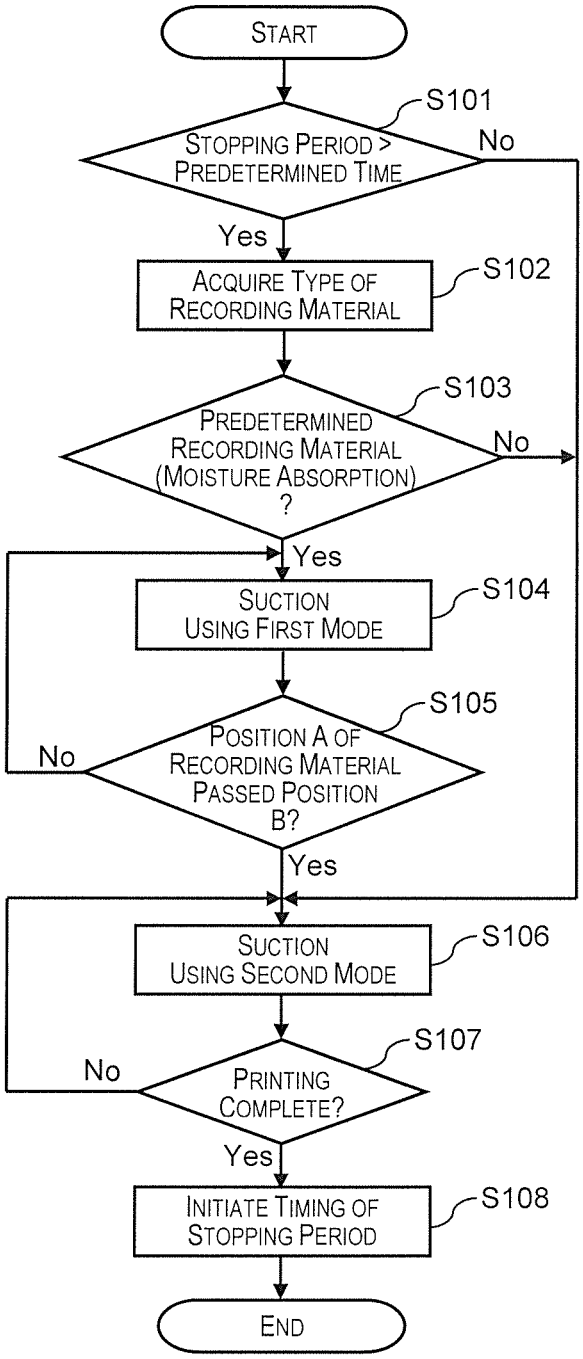
FIG. 14 is a flow chart that shows the control process for the suction part according to an embodiment of the present invention.
Figure 15:
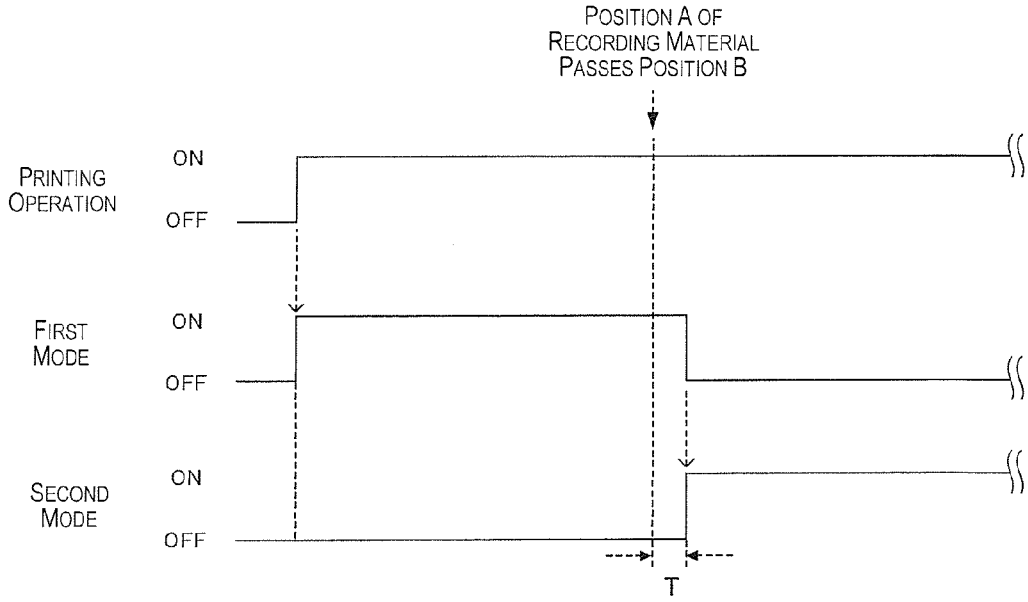
FIG. 15 is a time chart of the control of the suction part according to an embodiment of the present invention.

The control of the suction part 16 as performed using such a control configuration will now be described. FIG. 14 is a flow chart that shows the control process for the suction part 16 according to the embodiment of the present invention, and FIG. 15 is a time chart of the control of the suction part 16. This process is initiated along with initiation of the operation of the image-forming device. A switch is made in the present embodiment between a first mode for operating the suction part 16 using suction characteristics corresponding to the recording material S having ruffling, wrapping tendencies, or other problems, and a second mode for operating the suction part 16 using normal suction characteristics.

When the process is initiated, a judgment is made as to whether or not the stopping period of the image-forming device, i.e., the period during which the recording material S was released, was greater than or equal to a predetermined time (S101). In cases where the predetermined time has not elapsed, the process proceeds to S106, the suction part 16 is operated using the second mode (normal mode), and printing is initiated. This process is based on the assumption that in instances where the stopping time is short (on the order of several minutes), the amount of moisture absorbed is not enough to generate problems in the recording material S. In S102, a judgment is made concerning the type of the recording material S that is set in the image-forming device, and the suction part 16 continues to be operated using the second mode for instances where the type of recording material (e.g., specific films) is such that moisture-absorption problems do not occur (S 106).

The normal second mode is thus executed in the present embodiment without executing the first mode based on the stopping period, the type of the recording material S, or other criteria. Additionally, the humidity, temperature, and other external factors that generate problems in the recording material S may be detected in the vicinity of the image-forming device by the environment-detecting part 130, and determinations may be made based on the results. The determination of whether or not to execute the first mode may also be omitted.

In S104, suction control of the suction part 16 is executed using the first mode. The suction part 16 in the present embodiment suctions the recording material S using an amount of suction that is larger than in the second mode. The amount of suction of the suction part 16 in such instances may be determined and implemented on the basis on the type of the recording material S as set using the input operating part 120 or the like, and the humidity, temperature or other external factors detected by the environment-detecting part 130. A switch from the first mode to the second mode is executed on the condition (S105: Yes) that the portion of the recording material S that was positioned at the position A upon the initiation of printing has passed the position B, i.e., on the condition that the exposed length L1 in FIG. 12 has been conveyed.

A buffer is provided to the recording material S fed out from the feeder 40 in the present embodiment, whereby the dancer roller 31 is provided for preventing slackening of the recording material S. The dancer roller 31 moves up and down according to the state of printing, but the exposed length L1 described using FIG. 12 changes according to the vertical position of the dancer roller 31. The dancer roller 31 is therefore put at a predetermined position when the image-forming device is stopped, whereby the exposed length L1 can be accurately determined. Alternatively, the exposed length L1 may be determined based on the position of the dancer roller 31. The determination of the exposed length L1 is thus preferably made while including the dancer roller 31 and other changes in the travel system between the position A and the position B.

The character of the switch between control modes is shown in the timing chart of FIG. 15. Printing is initiated, and a time lag T is provided for the mode switch in the present embodiment. Once the recording material at position A has definitely passed position B, a switch is made from the first mode to the second mode. Ruffling and wrapping tendencies produced by moisture absorption or wrapping about small-diameter rollers are mitigated using the first mode, which uses strong suction force. Deterioration of image quality is minimized, and damage to the image-forming heads 11 is also prevented. Running the system in the second mode, which uses a weaker suction force than the first mode, for portions of the recording material S that were rolled up in the recording material roll Sa while stopped allows the conveying functionality of the recording material S to be improved, and allows the correction response characteristics (steering functionality) of the meander-correcting part 20 to be enhanced. Since the switch between modes does not require driving force on the rollers, power is conserved, and the lifespan of the drive system is increased.

When a determination is made that printing has completed (S107: Yes), the drive systems of the image-forming device are stopped, and timing of the stopping period is initiated (S108). The timed stopping period is used in the determination of S101 upon initiating printing.

As described above, the suction characteristics of the suction part are changed between portions of the recording material S that were released while in a state of being fed out from the recording material roll Sa during stopping and that may have ruffling or wrapping tendencies, and portions of the recording material S that were wrapped in the recording material roll Sa during stopping, whereby the quality of the image formed is improved, and the various issues that occur as a result of the recording material S contacting the image-forming heads 11 can be limited. The amount of rotation of the sirocco fan 165 as described using FIG. 9 is adjusted in the present embodiment, whereby the amount of aspiration is changed across the entire suction surface, but the characteristic that is changed in the suction part 16 may be the distribution of aspiration amounts.

Figure 16:
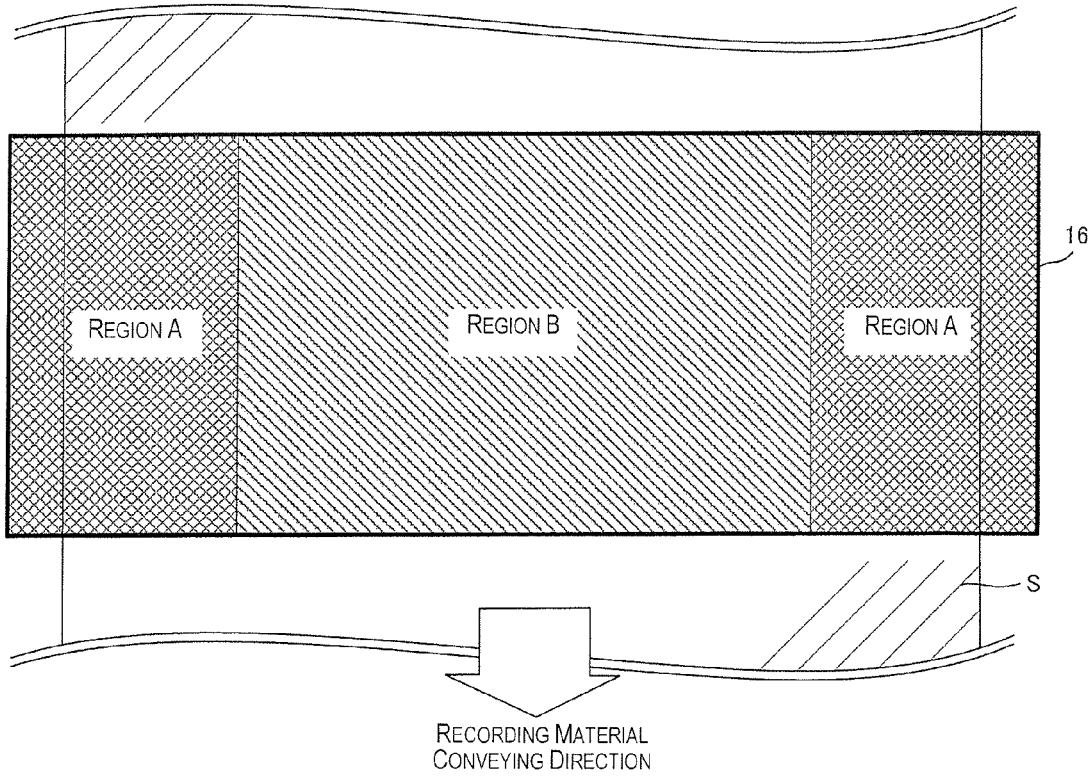
FIG. 16 shows the placement relationship of the suction part and the recording material according to an embodiment of the present invention.
Figure 17:
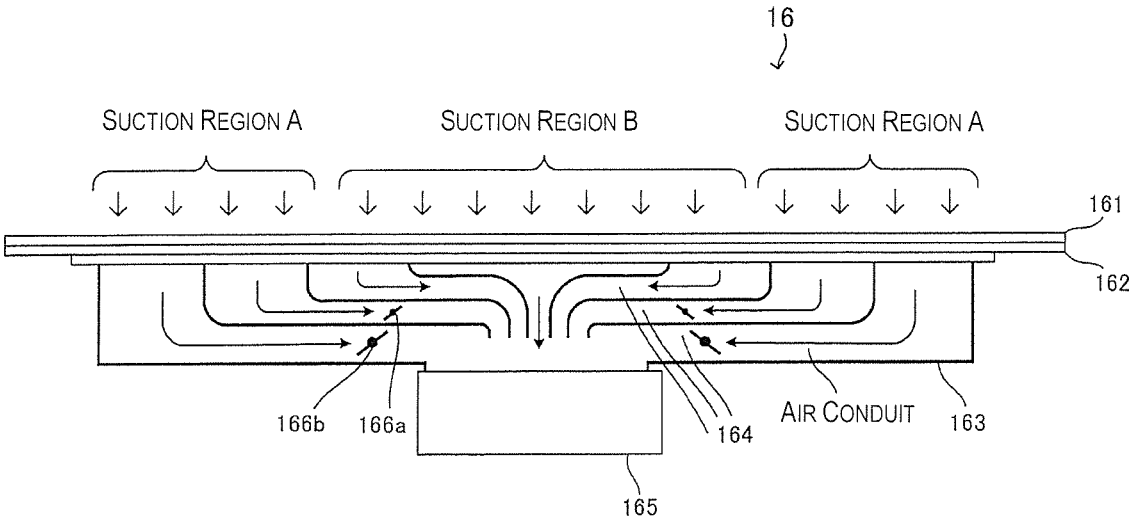
FIG. 17 is a cross-sectional view that shows the configuration of the suction part according to another embodiment of the present invention.
Figure 18:
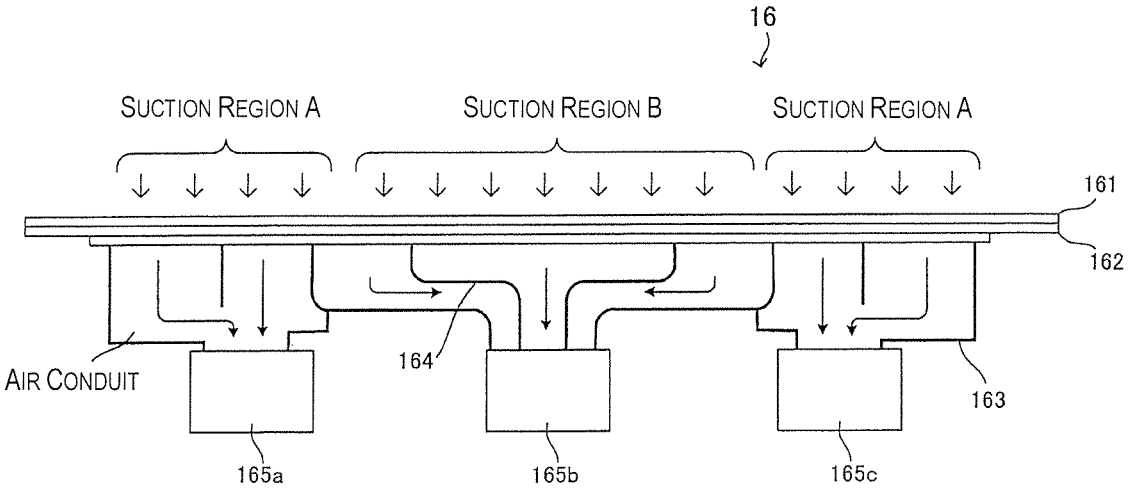
FIG. 18 is a cross-sectional view that shows the configuration of the suction part according to another embodiment of the present invention.

FIGS. 16 through 18 depict embodiments in which the distribution of suction amounts is changed in such a suction surface. FIG. 16 shows the positional relationship between the suction part and the recording material according to an embodiment of the present invention, and FIGS. 17 and 18 are cross-sectional views that show the configuration of the suction part according to other embodiments of the present invention.

FIG. 16 is a view of the suction part 16 from the direction of the image-forming heads 11 and shows the positioning of the conveyed recording material S and the suction surface of the suction part 16. Ruffling, edge curling, wrapping tendencies, and other problems are notably present at the edge part of the recording material S. The suction surface of the suction part 16 in the present embodiment is therefore divided into three regions (two regions A and a region B). Strong suction force is produced at the regions A of the edge parts of the recording material S. In the aforedescribed first mode, the suction force at the regions A is increased, whereby the ruffling and wrapping tendencies produced at the edge parts of the recording material S can be effectively eliminated. The suction distribution between the regions A and the region B may also be different even in the second mode, and control may also be implemented such that the overall suction force is matched in the first and second modes, as in the aforedescribed embodiment.

FIG. 17 shows the configuration of the suction part 16 for changing the suction distribution of the suction surface in this way. Adjustment valves 166*a*, 166*b* that can control the degree of opening of the air conduits of the suction part 16 described using FIG. 9 are provided in this embodiment, whereby the amount of suction at the suction regions A is controlled. Controlling the amount of rotation of the sirocco fan 165 allows the overall amount of suction to be controlled.

FIG. 18 shows the configuration of another version of the suction part 16 for controlling the distribution of suction amounts. In this embodiment, different air conduits are provided to each of the different regions, and the amount of aspiration of separate sirocco fans 165*a* through 165*c* for the respective air conduits is controlled, whereby the suction distribution and the overall amount of suction can be controlled.

Figure 19:
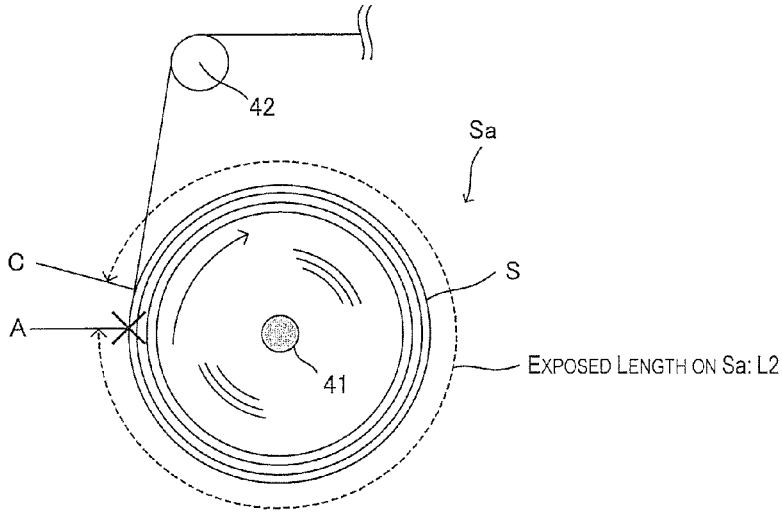
FIG. 19 depicts the location of the recording material in the image-forming device according to another embodiment of the present invention.

The recording material S that was subjected to the air during stopping as described using FIG. 12 was exposed not only from the position A to the position B but on the surface of the recording material roll Sa. One side of the recording material S positioned on the surface of the recording material roll Sa in this way absorbs moisture in the air, and ruffling may occur. FIG. 19 depicts the location of this recording material S. During stopping the recording material S on the recording material roll Sa is subjected to the air over the region of an exposed length L2 from position A to position C, as shown by the broken line.

The suction characteristics of the suction part 16 could also be controlled to handle these portions. As opposed to the exposed length L1, where both sides are exposed from position A to position B, only one side is exposed in the exposed length L2, and therefore the suction characteristics are also preferably changed accordingly in such instances.

Figure 20:
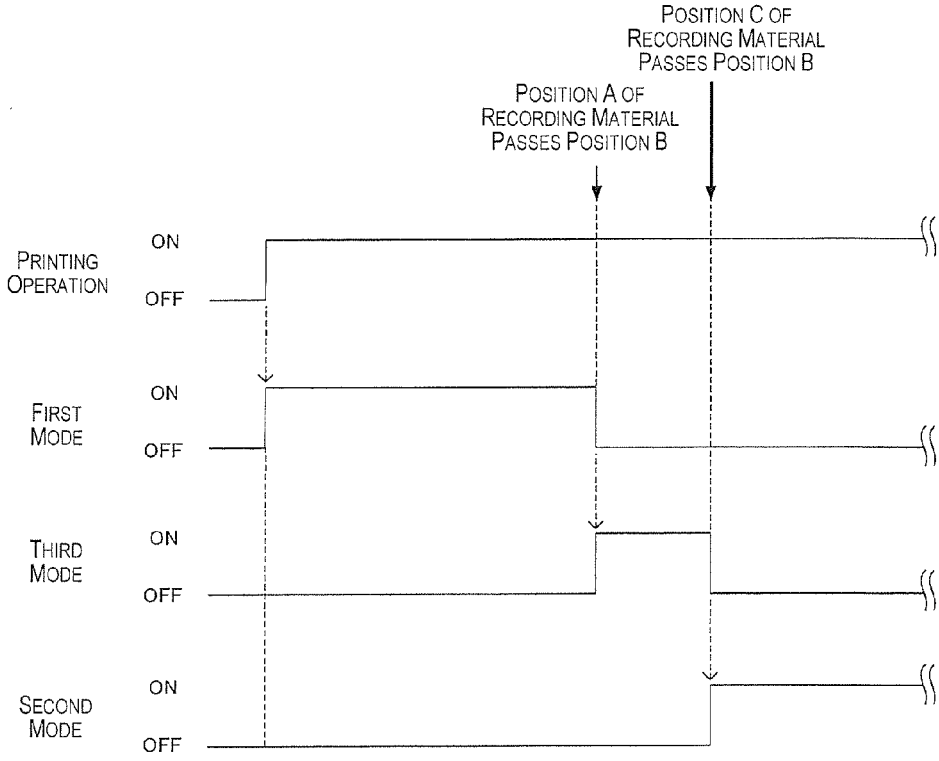
FIG. 20 is a time chart of the control of the suction part according to another embodiment of the present invention.

A time chart of the control of the suction part 16 in such instances is shown in FIG. 20. A new third mode is provided in this control scheme for the recording material S of the exposed length L2 that was only exposed on one side. The suction characteristics in the third mode are weaker than in the first mode and stronger than in the second mode, whereby the exposed length L2 portion of the recording material S that was exposed on only one side can be handled. Specifically, suction is executed using mode 1 until the portion of the recording material S that was positioned at the position A during stopping passes the position B. Thereafter a switch is made to mode 3, and the suction characteristics are changed to those appropriate to the exposed length L2. The recording material S that was positioned at the position C during stopping then passes the position B, whereby a switch is made to the normal second mode, and printing is continued.

Appropriate suction characteristics can thus also be provided to the recording material S that was positioned on the surface of the recording material roll Sa in the present embodiment. The image formed is improved, and the burden on the conveying system for the recording material is lessened. As in the previous embodiment, the suction characteristics of the various modes are preferably changed based on the type of the recording material S used, the conveying speed of the recording material S, and the temperature, humidity, or other factor in the external environment. The present embodiment handles the recording material S on one surface layer of the recording material roll Sa, but in cases where the recording material S is highly moisture absorbing, moisture absorption may occur across several layers. The same control scheme may therefore also be implemented for the recording material S that was within the recording material roll Sa during the stopping period.

Figure 21:
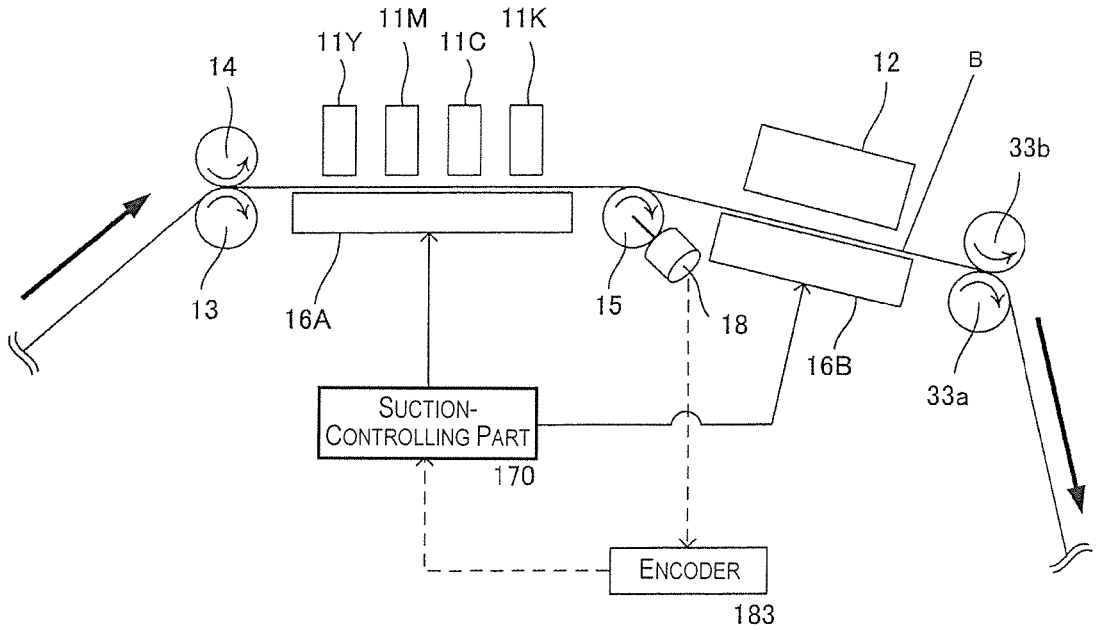
FIG. 21 shows the control configuration of the suction part according to another embodiment of the present invention.

The suction part 16 in the aforedescribed embodiment was disposed at a position facing the image-forming heads 11 but could also be disposed at a position facing the UV irradiator 12. FIG. 21 shows the control configuration of the suction part 16 according to another embodiment of the present invention. As shown in FIG. 21, in the present embodiment, besides a suction part 16A disposed at a position facing the image-forming heads 11, a suction part 16B is also disposed at a position facing the UV irradiator 12. The suction control part 160 controls the suction part 16B and can thereby change the suction characteristics of the suction part 16B.

When using UV-curable ink, irradiating UV rays and curing may lead to contraction. The contraction of the ink itself becomes a contraction of the recording material S, and therefore wrinkling may occur in the final, completed product. Therefore, in the present embodiment, the UV irradiator 12 is used to irradiate UV rays onto the recording material S, and the recording material S is suctioned, whereby the occurrence of such wrinkling is minimized, and the quality of the product is improved.

In the aforedescribed embodiments, the position at which ink discharge by the image-forming heads 11 is complete was designated as the image-forming completion position B (FIG. 12), but in the case of configurations such as that of the present embodiment, the image-forming completion position B is preferably designated as the position at which UV irradiation by the UV irradiator 12 is completed. For recording materials for which moisture absorption and the like are problems, suction is performed using the first mode until passing the position B, and the ink can be fixed on the recording material S in a state in which ruffling and wrapping tendencies are minimized even during UV irradiation.

Various embodiments were described in the present specification, but embodiments configured from appropriate combinations of the respective configurations of the embodiments also fall under the category of the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image-forming device comprising:

an image-forming part configured and arranged to form an image on a recording material that is rolled up in a recording material roll;

a conveying part configured and arranged to feed out the recording material from the recording material roll and to convey the recording material to the image-forming part;

a suction part configured and arranged to suction the recording material conveyed by the conveying part, the suction part being disposed at the image-forming part;

a conveyance-condition-detecting part configured to detect when a part of the recording material positioned at a feed-initiation position upon an initiation of conveying the recording material has reached an image-forming completion position; and a control part configured to change a suction characteristic of the suction part between before and after the part of the recording material positioned at the feed-initiation position upon the initiation of conveying the recording material reaches the image-forming completion position.

2. The image-forming device according to claim 1, wherein the image-forming part includes an image-forming head configured and arranged to discharge ink onto the recording material and to form the image, and the suction part has a first suction part disposed at a position facing the image-forming head.

3. The image-forming device according to claim 2, wherein the ink discharged by the image-forming head is photo-curing ink, the image-forming part has a light-irradiating part configured and arranged to cure the photo-curing ink on the recording material, and the suction part has a second suction part disposed at a position facing the light-irradiating part.

4. The image-forming device according to claim 1, wherein the suction characteristic controlled by the control part includes a suction-amount distribution in a direction perpendicular to a direction in which the recording material is conveyed.

5. The image-forming device according to claim 1, wherein the suction characteristic controlled by the control part is controlled based on a type of the recording material, which is set using an input part.

6. The image-forming device according to claim 1, wherein the suction characteristic controlled by the control part is controlled based on a period from stopping of conveyance of the recording material by the conveying part until conveyance is initiated.

7. An image-forming device comprising:

an image-forming part configured and arranged to form an image on a recording material that is rolled up in a recording material roll;

a conveying part configured and arranged to feed out the recording material from the recording material roll and to convey the recording material to the image-forming part;

a suction part configured and arranged to suction the recording material conveyed by the conveying part, the suction part being disposed at the image-forming part; and a control part configured to control a suction characteristic of the suction part according to a conveyance amount of the recording material after the recording material has begun to be conveyed by the conveying part the control part being configured to control the suction characteristic such that a suction amount for the recording material that has been fed out from the recording material roll upon an initiation of conveying the recording material is larger than a suction amount for the recording material that was wrapped up in the recording material roll upon the initiation of conveying the recording material.

8. A method for forming an image on a recording material, comprising:

feeding out the recording material from a recording material roll resulting from rolling up the recording material, and conveying by a conveying part the recording material to an image-forming part for forming an image on the recording material;

suctioning the recording material using a suction part;

forming the image on the recording material;

detecting when a part of the recording material positioned at a feed-initiation position upon an initiation of conveying the recording material has reached an image-forming completion position; and changing a suction characteristic of the suction part between before and after the part of the recording material positioned at the feed-initiation position upon the initiation of conveying the recording material reaches the image-forming completion position.

* * * * *